United States Patent [19]

Corke et al.

[11] Patent Number: 4,961,316

[45] Date of Patent: Oct. 9, 1990

[54] CONTROLLED ELECTRIC PUMP DRIVE FOR HYDRAULIC LIFTING ARRANGEMENT WITH GAS SPRING IN MOTOR

[75] Inventors: Andrew Corke; Lennart Johansson, both of Mjölby, Sweden

[73] Assignee: BT Industries Aktiebolag, Mjölby, Sweden

[21] Appl. No.: 261,239

[22] Filed: Oct. 21, 1988

[30] Foreign Application Priority Data

Oct. 28, 1987 [SE] Sweden ..... 8704216

[51] Int. Cl.[5] ..... B66F 9/22

[52] U.S. Cl. ..... 60/431; 60/433; 60/475; 60/476; 60/486; 92/134; 267/64.11; 187/9 R

[58] Field of Search ..... 187/9 R; 267/64.11; 414/529, 629, 631; 60/371, 372, 431, 433, 473, 475–476, 486; 92/113, 134

[56] References Cited

U.S. PATENT DOCUMENTS

| | | | |
|---|---|---|---|
| 3,512,072 | 5/1970 | Karazija et al. | 187/9 R |
| 3,630,025 | 12/1971 | Henry | 60/431 X |
| 3,672,470 | 6/1972 | Ohntrup et al. | 187/9 R X |
| 3,788,076 | 1/1974 | Lansky et al. | 60/431 X |
| 3,868,821 | 3/1975 | Ratliff et al. | 60/486 X |
| 3,903,698 | 9/1975 | Gellatly et al. | 60/476 X |
| 4,509,127 | 4/1985 | Yuki et al. | 414/629 X |
| 4,543,031 | 9/1985 | Luebrecht et al. | 414/631 |
| 4,655,039 | 4/1987 | McCabe et al. | 60/433 X |
| 4,723,107 | 2/1988 | Schmid | 414/529 X |
| 4,761,954 | 8/1988 | Rosman | 60/372 X |
| 4,811,562 | 3/1989 | Hoffman et al. | 60/473 X |

FOREIGN PATENT DOCUMENTS

| | | | |
|---|---|---|---|
| 214341 | 5/1956 | Australia | 60/486 |
| 979785 | 12/1975 | Canada | 60/486 |
| 2551489 | 5/1976 | Fed. Rep. of Germany . | |
| 2529216 | 10/1976 | Fed. Rep. of Germany . | |
| 135388 | 11/1983 | Japan . | |

*Primary Examiner*—Edward K. Look
*Assistant Examiner*—George Kapsalas
*Attorney, Agent, or Firm*—Frishauf, Holtz, Goodman & Woodward

[57] ABSTRACT

A hydraulic lifting arrangement for a lift assembly on a materials-handling vehicle includes a working piston-cylinder device (17) for raising and lowering the lift assembly, a reversible pump assembly (40) for operating the piston-cylinder device, and an electric motor for driving the pump assembly. The piston-cylinder device (17) is a double-acting device and has two working chambers (28,29), which are connected to the pump assembly by connecting pipes (46,47). The pump assembly comprises a first and a second hydraulic pump (41,42) having fixed displacements. The pumps are so arranged in the system that together they supply hydraulic medium to and receive hydraulic medium from solely the first chamber (28) whereas only the pump motor (41) supplies and receives hydraulic medium to and from the second chamber (29). The relationship between the displacement of the first pump (41) and the sum of the displacements of both pumps (41,42) corresponds essentially to the relationship between the respective active piston areas in the second and the first chambers. Conveniently, a pressure-gas chamber (26) is arranged in the piston-cylinder device for biassing the piston (19) so as to enable the dead weight of the lift assembly and a given part of the load to be counterbalanced.

9 Claims, 1 Drawing Sheet

Figure 1:
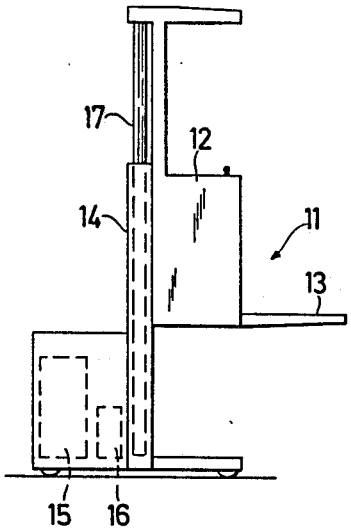

CONTROLLED ELECTRIC PUMP DRIVE FOR HYDRAULIC LIFTING ARRANGEMENT WITH GAS SPRING IN MOTOR

The present invention relates to a hydraulic lifting arrangement for a lift assembly on materials-handling vehicles, including a working piston-cylinder device which comprises a cylinder housing having movably arranged therein a piston for raising and lowering the assembly, and further including a pump assembly which is driven by an electric motor and which incorporates a conduit system for operating the piston-cylinder device.

Ever increasing demands are placed on the efficiency and effectiveness of such lifting arrangements. With regard to efficiency, the greatest endeavours have been concentrated on improving the battery-drive of such arrangements, e.g. a more efficient accumulation of electrical energy and more rapid re-charging of the electrical system. Only modest successes have been achieved, however.

The demands on effectiveness are concerned with higher lifting speeds in the case of the lift assembly and improved possibilities of finely positioning the assembly. This latter requirement means, inter alia, that the manipulation of the controls by the operator shall be reflected accurately in the actual movements performed by the moveable assembly components. A higher lifting speed presumes larger motors, pipes of larger diameters and a higher current consumption, which in turn increases the dead weight of the lifting arrangement. The weight of the movable components also tends to increase as a result of other factors. For example, the demands for higher lifting heights and heavier load carrying capacities, or a more rigid lifting mast, result in a more robust and heavier construction, which also applies to the operator's cabin and other forms of auxiliary equipment.

This increase in dead weight will, of course, detract from the possibility of achieving higher speeds and of improving the accuracy to which the lift assembly can be positioned, and consequently one object of the present invention is to provide a hydraulic lifting arrangement which is influenced to the smallest extent possible by the dead weight of the movable components. Other objects include the provision of a highly efficient lifting arrangement whose hydraulic system can be constructed from simple and operationally reliable components. Further objects of the invention and advantages afforded thereby will be apparent from the following description. These objects are achieved with a lifting arrangement having the characterizing features set forth in the following claims.

The invention is based on the realization that a double-acting piston-cylinder lifting device can be controlled more effectively than the single-acting piston-cylinder devices used hitherto in this technical field and can also be given other characteristics. Thus, according to the present invention, the lifting arrangement is provided with a double-acting piston-cylinder device which is driven with the aid of two hydraulic pumps, the displacements of which are constant but mutually different, said displacements being selected so as to be in a given relationship to the different piston areas of the piston-cylinder device on the lifting and lowering side respectively. According to a further development of the invention, the two hydraulic pumps are coupled to one and the same drive motor shaft and at least one is reversible without the provision of a separate valve arrangement. The piston-cylinder device is preferably equipped with an integrated gas spring capable of balancing out the dead weight of the movable components or parts of the lifting arrangement and also parts of the useful load.

Figure 2:
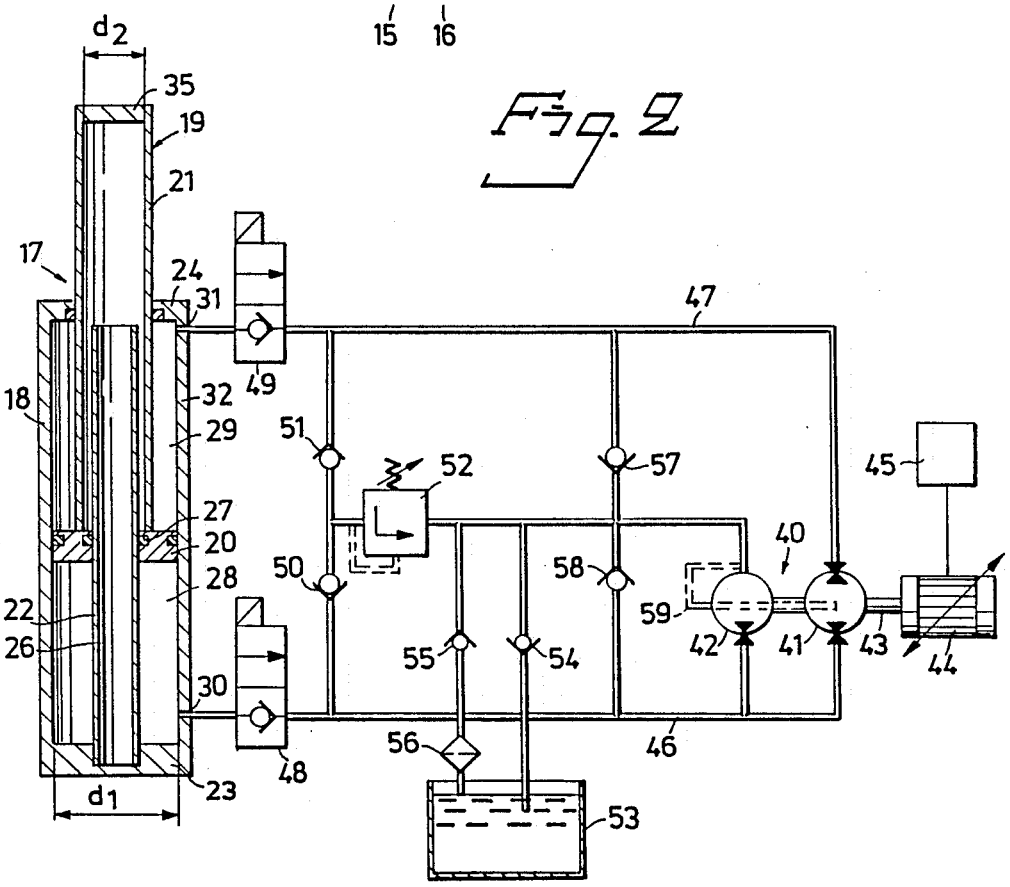

The invention will now be described in more detail with reference to the accompanying drawing, in which FIG. 1 is a schematic side view of an industrial fork-lift truck equipped with an inventive lifting arrangement; and FIG. 2 is a schematic cross-sectional view of a working piston-cylinder device included in the lifting arrangement and also illustrates schematically a hydraulic system for co-action with the piston-cylinder device.

The illustrated industrial truck is of the kind which is used in certain types of pick-up stores and is therefore provided to this end with a lift assembly 11 with a built-in operator cabin 12. The various loads are handled with the aid of suitably constructed lifting forks 13. The lift assembly 11 is mounted for vertical movement along a mast 14 mounted on the vehicle chassis, which also carries an arrangement of electrical batteries 15, electric motors 16 etc. for propelling the vehicle and for carrying out the lifting functions thereof. The lift assembly is raised and lowered directly with the aid of a working piston-cylinder device 17. As will be seen from FIG. 2, the piston-cylinder device 17 includes a cylinder housing 18 and a double-acting piston assembly 19 which is movable axially in the cylinder and which comprises a piston head 20 and a piston rod 21. The piston-cylinder device 17 has located centrally therein a tube 22 which extends from one end wall 23 of the cylinder housing and passes axially through the housing to the opposite end wall 24 thereof. The tube 22 also extends through a bore in the piston head 20 and into the piston rod 21, which is of hollow tubular construction. The tube 22 and the piston assembly 19 enclose an inner pressure chamber 26 which is isolated from the chamber of the piston-cylinder device by a seal 27. The chamber of the piston-cylinder device is, in turn, divided into first and second working chambers 28,29 each of which has a circular cross-section and each of which is provided with a respective opening 30,31. In the illustrated case, the first working chamber 28 is bounded by the tube 22 and the cylinder wall 32, whereas the second working chamber 29 is bounded by the piston rod 21 and the cylinder wall 32. The outer and inner seals are arranged in the piston head 20 in a manner which will enable the dimensions of the piston head to be kept down and adapted to the desired cross-sectional area of the respective chambers 28,29. The pressure chamber is suitably closed and filled with a gas, e.g. nitrogen. The volume of the pressure chamber is an approximative linear variable of the length of stroke of the piston 19, as known per se, and hence the enclosed gas will give rise to a spring force which is proportional to the pressure prevailing in the chamber and internal area of the outwardly projecting end 35 of the piston rod. Suitable selection of these variables will enable the spring force to be adapted to the dead weight of the lift assembly and also to part of the useful load. Dimensions and pressure, however, are suitably selected so that at most half the total load need be lifted with external motor power, which thus means that energy must be supplied when an empty load carrier is to be lowered.

The pressure chamber 26 should have a relatively large cross-sectional area, so that the functions of said chamber can be achieved at a lower gas pressure. Furthermore, in order to be able to dimension the piston-cylinder device to the degree of dimensional-compactness required, it is essential that the full length of piston stroke can be utilized, which also implies that the cross-sectional area of the pressure chamber 26 should be as large as possible in relation to the cross-sectional area of respective working chambers 28,29. It has been found with regard to the respective internal diameters $d_1$ and $d_2$ of the cylinder housing 18 and the piston rod 21 that an advantage is gained when the diameter $d_2$ is greater than half of the diameter $d_1$.

The piston-cylinder device 17 is operated by means of a hydraulic system constructed of simple components which are reliable in operation and which are particulary suited for manipulation manually from remote locations, e.g. from the cabin 12 on the lift assembly. The illustrated hydraulic system includes a pump assembly 40 which comprises a first, reversible hydraulic pump 41 of the 4-quadrant kind with fixed displacement, and a second hydraulic pump 42 which also has a fixed displacement. This latter pump 42 is, in itself, rotatable in two directions, but is preferably of the 2-quadrant kind. The pumps 41,42 are mounted on a common shaft 43 and are driven by an electric motor 44 the speed and rotational direction of which can be controlled by a control means 45 in a manner known per se. Each of the working chambers 28,29 is connected to the pump assembly 40 by means of a respective pipe 46,47 each of which incorporates a respective actuable check valve 48,49. The system also includes pressure regulating means in the form of non-return valves 50,51 and a pressure limiting valve 52. In addition hereto, the system also includes a small hydraulic tank 53 and a non-return valve 54 in the pipe leading to the pump 42, together with a non-return valve 55 and an oil filter 56 in the return pipe to the tank. The hydraulic system also includes two non-return valves 57,58 for preventing cavitation in the hydraulic pump 41 and in both pumps 41,42 respectively, as hereinafter described. An internal drainage channel 59 extends from both the first and the second pump and discharges on the suction side of said second pump. The control means 45 is operated from the operator cabin and is constructed or otherwise engineered to transmit suitable control signals, inter alia, to the motor 44 and the check valves 48,49 in response to corresponding commands from the operator control. To this end certain constants, slowest pump speed, pre-control parameters, etc., are set in the electric circuitry of the control means so as to obtain suitable coordination between hydraulic pressure and the opening and closing of the valves 48,49.

The hydraulic system is constructed to deliver to the piston-cylinder device 17 precisely the amount of oil required in respective working chambers 28,29, so that the smallest possible amount of oil need be supplied to or taken from the tank 53. The active piston area is different in the two working chambers 28,29, which means that different amounts of oil must be delivered to the chambers in order to avoid pumping oil back to the tank unnecessarily.

This problem is solved in accordance with the invention by means of the parallel-coupled pumps 41 and 42. In this case, the following relationship applies:

$$\frac{D_M}{D_M + D_p} = \frac{A_1}{A_2}$$

where $D_M$=the displacement of the first hydraulic pump 41, $D_p$=the displacement of the second hydraulic pump 42, $A_1$=the piston area in the working chamber 29 and $A_2$=the piston area in the working chamber 28. For instance, the areas and displacements can be selected so that if during a lifting movement the flow to the working chamber 28 is 100%, the flow from the working chamber 29 will only be 63%. In this case, the relationship between the pumps will also be such that the flow through the first pump 41 is 63% of the total flow through both the first pump 41 and the second pump 42. Thus, when a load is lifted the pump 42 will supply the system with the remaining 27% of the flow to the working chamber 28. The flow from the working chamber 29 will normally be slightly less than that required by the pump 41 in order to avoid the risk of cavitation. This is avoided, however, since a given amount of additional oil can be taken from the tank through the non-return valve 57.

When a load is lowered, oil is supplied to the working chamber 29 by the pump 41, i.e. in the illustrated case with 63% of the total flow. The flow from the chamber 28 will be then 1.6 times greater than the flow to the chamber 29. The oil surplus is fed back to the tank through the pump 42. The non-return valve 58 is installed in order to prevent cavitation from occurring. When a load is lowered, the pressure in the chamber 28 may be greater than zero, and the pump 42 will then co-act with the electric motor 44, which means that pressure energy in the oil returned to the tank is conserved. The hydraulic system can be considered an essentially fully closed system, which means that the pump assembly 40 is unable to operate above a given highest pump speed and will not therefore race or overrun.

If the piston-cylinder device tends to work at a faster rate than the pump 41, due to the influence of an external load, the pump will build up a higher pressure on the other side of the device, in the working chamber 28. Consequently, both sides of the pump will constantly be influenced by oil under pressure, which means that no play or clearances are formed and that lifting movements can be controlled very efficiently. The hydraulic system is therefore very rigid. The speed of the pump assembly 40 is controlled with the aid of thyristors in the control means 45, which reduce the speed of the electric motor 44 through regenerative braking or progressive runback of the equipment. The bias in the pressure chamber 26 can be selected at a level which will ensure that the whole of the dead weight and, e.g., half of the useful load is counterbalanced. The closed hydraulic system of the inventive lifting arrangement will afford constant control over the movements of the components, even when it is necessary to brake the load-free piston 19 or when the O-position is passed.

In summary, the arrangement of two pumps on one and the same shaft results in a stiffer hydraulic system, so that the position and speed of the pistons can be better controlled. The arrangement also provides good control of movement when the piston passes the point of balance between gas pressure and load. The system is also constructed of simple components which can be controlled readily from remote locations, and the gas charge enables higher speeds to be reached while maintaining energy consumption at the same level as the slower conventional systems. Because movement can be controlled in a highly satisfactory manner, overbalancing can be permitted.

We claim:

1. A hydraulic lifting arrangement for a lift on a materials-handling vehicle, said arrangement comprising a working piston-cylinder device which includes a cylinder housing having axially movable therein a piston with a hollowed piston head and a hollow piston for raising and lowering the lift assembly, and further comprising a pump assembly which co-acts with a system of pipes for operating the piston-cylinder device, and an electric motor for driving the pump assembly; wherein the piston-cylinder device is a double-acting device having a first and a second working chamber which are isolated sealingly from one another, and includes a tube which extends into the piston head of the piston rod and sealingly delimits a pressure chamber arranged to act as an integrated gas spring for biassing the piston-cylinder device; the pump assembly includes a first and a second hydraulic pump of which at least the first pump is a reversible pump, and the pumps are mutually connected in parallel.

2. A lifting arrangement according to claim 1, wherein the ratio of the displacement of the first pump to the sum of the displacements of both pumps is substantially equal to the ratio of the piston area in the second chamber to the piston area in the first chamber.

3. A lifting arrangement according to claim 1, wherein the two pumps are mounted on a common drive shaft which is driven by an electric motor; and a control means is provided for controlling the rotational direction, speed and braking ability of said electric motor.

4. A lifting arrangement according to claim 1, wherein the first hydraulic pump is connected directly to a first and a second working chamber via respective connecting pipes; and the second hydraulic pump is connected directly to the first working chamber so that the flow of hydraulic medium from the two pumps is summated and passed to the first working chamber during outward displacement of the piston, whereas the return flow from the second working chamber is passed solely to the first hydraulic pump.

5. A lifting arrangement according to claim 4, wherein the arrangement is such that the flow of hydraulic medium from the first pump, which is reversible, is passed back to the second chamber during the inward retraction of the piston, whereas the return flow from the first chamber is passed to both the first and the second pumps.

6. A lifting arrangement according to claim 4, wherein a check valve is arranged in the connecting pipe between respective chambers and the pump assembly in a manner to enable the flow of hydraulic medium from one or both chambers to be shut off in response to control signals from the control means.

7. A lifting arrangement according to claim 6, wherein the control means includes electric devices intended for controlling the time at which the check valves are activated and deactivated on the basis of the speed of the electric motor, the pump direction and the build-up of pressure in the system.

8. A lifting arrangement according to claim 1, wherein the tube is mounted centrally in one end of the cylinder housing; and the working chambers are bounded respectively between the cylinder housing and the centrally located tube and between the cylinder housing and the piston rod.

9. A lifting arrangement according to claim 8 wherein the control means includes electric devices intended for controlling the time at which the check valves are activated and deactivated on the basis of the speed of the electric motor, the pump direction and the build-up of pressure in the system.

* * * * *